US009724552B2

(12) United States Patent
Schumacher

(10) Patent No.: US 9,724,552 B2
(45) Date of Patent: Aug. 8, 2017

(54) EXERCISE DEVICE WITH CONTINUOUS, FLEXIBLE PULLING MEMBER

(71) Applicant: aerobis fitness GmbH, Cologne (DE)

(72) Inventor: Elmar Schumacher, Cologne (DE)

(73) Assignee: aerobis fitness GmbH, Cologne (DE)

( * ) Notice: Subject to any disclaimer, the term of this patent is extended or adjusted under 35 U.S.C. 154(b) by 54 days.

(21) Appl. No.: 14/782,322

(22) PCT Filed: Dec. 17, 2013

(86) PCT No.: PCT/DE2013/100428
§ 371 (c)(1),
(2) Date: Oct. 3, 2015

(87) PCT Pub. No.: WO2014/166463
PCT Pub. Date: Oct. 16, 2014

(65) Prior Publication Data

US 2016/0243391 A1 Aug. 25, 2016

(30) Foreign Application Priority Data

Apr. 9, 2013 (DE) ..... 10 2013 103 510

(51) Int. Cl.
*A63B 21/015* (2006.01)
*A63B 21/018* (2006.01)
(Continued)

(52) U.S. Cl.
CPC ..... *A63B 21/018* (2013.01); *A63B 7/045* (2013.01); *A63B 21/0051* (2013.01);
(Continued)

(58) Field of Classification Search
CPC . A63B 21/151; A63B 21/153; A63B 21/0051; A63B 21/0056; A63B 21/015;
(Continued)

(56) References Cited

U.S. PATENT DOCUMENTS

2005/0148437 A1* 7/2005 Ryan ..... A63B 21/018 482/37
2006/0148622 A1* 7/2006 Chen ..... A63B 21/153 482/72
(Continued)

FOREIGN PATENT DOCUMENTS

DE 202007009543 U1 5/2008
WO 2006107266 B1 1/2007
(Continued)

OTHER PUBLICATIONS

International Search Report, Application PCT/DE2013/100428, Apr. 4, 2014.

*Primary Examiner* — Nyca T Nguyen
(74) *Attorney, Agent, or Firm* — Smartpat PLC

(57) ABSTRACT

An exercise device uses a guide member that is rotatably arranged on a shaft. A continuous, flexible pulling member wraps around the guide member and causes the guide member to rotate when the continuous, flexible pulling member is pulled. Two rotatable metal discs are arranged coaxially with the guide member on the shaft, one rotatable metal disc being arranged on each side of the guide member. A gear set is operatively connecting the guide member and the two rotatable metal discs. A magnetic cylinder is arranged substantially parallel to the shaft between the two rotatable metal discs such that a magnetic field passes through radially outer areas of the rotatable metal discs in a substantially axial orientation. The rotatable metal discs and the magnetic cylinder form an eddy current brake which counteracts a pulling motion on the continuous, flexible pulling member.

18 Claims, 5 Drawing Sheets

(51) Int. Cl.
*A63B 21/005* (2006.01)
*A63B 21/16* (2006.01)
*A63B 7/04* (2006.01)
*A63B 21/00* (2006.01)

(52) U.S. Cl.
CPC ..... *A63B 21/1645* (2013.01); *A63B 21/4035* (2015.10); *A63B 2210/50* (2013.01)

(58) Field of Classification Search
CPC . A63B 21/018; A63B 21/154; A63B 21/0052; A63B 21/0057; A63B 2022/0079; A63B 7/04; A63B 7/045; A63B 21/012; A63B 21/0125; A63B 21/15; A63B 21/00151
USPC ..... 242/288, 379
See application file for complete search history.

(56) References Cited

U.S. PATENT DOCUMENTS

2008/0083589 A1* 4/2008 Yin ..... A63B 21/0051 188/164
2009/0036276 A1* 2/2009 Loach ..... A63B 21/15 482/72
2009/0137370 A1* 5/2009 Kushnir ..... A63B 21/00069 482/120
2010/0041520 A1* 2/2010 Popescu ..... A63B 23/1209 482/37
2010/0308149 A1* 12/2010 Allington ..... A62B 1/08 242/379
2014/0221179 A1* 8/2014 Chen ..... A63B 21/0051 482/130
2014/0296038 A1* 10/2014 Colan ..... A63B 69/16 482/61
2014/0357457 A1* 12/2014 Boekema ..... A63B 21/00069 482/124

FOREIGN PATENT DOCUMENTS

WO 2007015096 A2 2/2007
WO 2012156516 A2 11/2012
WO 2012165945 A1 12/2012

* cited by examiner

*Fig. 3*
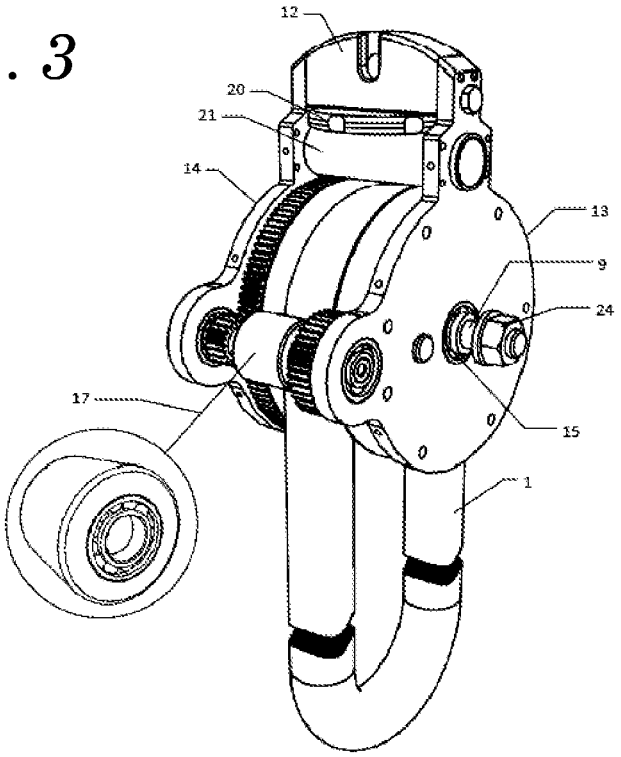
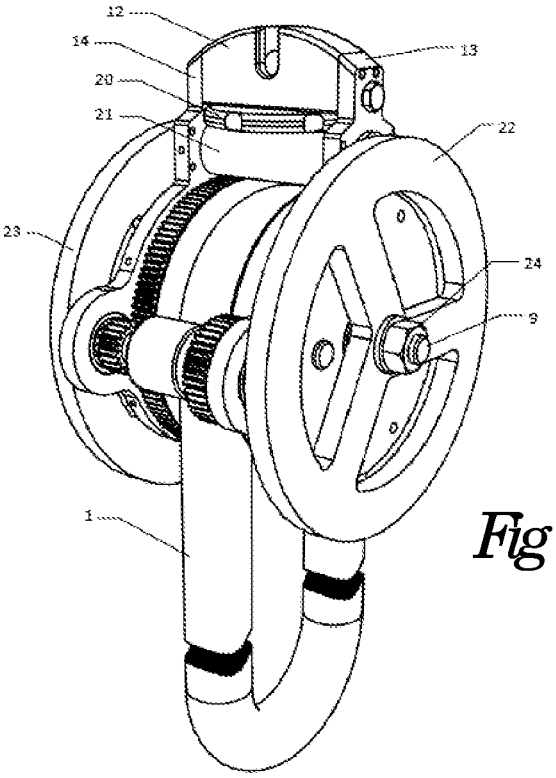
*Fig. 4*

EXERCISE DEVICE WITH CONTINUOUS, FLEXIBLE PULLING MEMBER

TECHNICAL FIELD

The present invention relates to a device for performing strength exercises using a continuous, flexible pulling member with user-adjustable resistance.

BACKGROUND

An exercise apparatus with a device for performing strength exercises using a continuous pulling member is known from U.S. Pat. No. 8,025,608 B2. This apparatus has a supporting framework, a continuous rope, and a means for a resistance to be applied to the rope by the user. A plurality of pulleys is provided on the device in order to apply a particular resistance to the continuous pulling member. A drawback of this apparatus is its technically complex design and its size. The exercise apparatus cannot easily be transported, if at all, and is not suited for mobile use.

A transportable exercise apparatus is known from US 2005/0148437 A1 which has a device that can be vertically adjusted and fixed to a vertical support and with which a pulling motion can be simulated using a continuous pulling member. A variable resistance can be applied to the pulling member using a setting screw and a pressure exerted on the guide channel by screwing in the setting screw. During operation, the user sits on a vertically and horizontally adjustable surface to the support the exercise apparatus. The exercise apparatus can be folded up and repositioned, but can nonetheless be transported only with difficulty due to its weight and size. Due to its technically complex design, and due to the design of the means for generating the resistance on the continuous pulling member, the device itself is also not well suited for mobile use.

SUMMARY

The present disclosure describes an exercise device which eliminates the aforementioned drawbacks and is constructed in such a way that it can be comfortably transported, e.g. in a bag or backpack. The device may be transported by any other suitable mobile means of transport and storage, or in some other manner. The disclosed device is designed to be technically simple and compact in its construction.

The device comprises a guide member mounted rotatably on a shaft. The guide member is driven by a continuous pulling member which wraps around the guide member. A brake is provided by which a variably adjustable resistance can be applied to the continuous pulling member.

At least one variably adjustable eddy current brake is provided at the guide member. The eddy current may be induced in at least one metal disc rotating in a magnetic field for braking or for generating the resistance on the guide member.

The advantage of positioning an eddy current brake directly on the guide member which interacts with the continuous pulling member is that, in contrast to the previous solutions discussed above, this provides a highly compact construction. The exercise device is highly efficient and variably adjustable, and thus requires no elaborate mechanical aids to generate resistance directly on the pulling member. A further advantage of this device is that, due to its small number of components in comparison with the devices of the prior art, it can be manufactured very cost-effectively. A further advantage of using an eddy current brake is that this brake is free from wear.

The device may be designed so that it can easily be attached to different suspension points, such as a tree branch, door frame, or other suitable fixed structures. A mounting is provided on the device for this purpose.

In addition to the exemplary applications of the device described above, the device may also function as part of a larger exercise apparatus in which it serves as the primary working element, e.g. where the continuous pulling member is led along pulleys or other elements that guide the pulling member.

BRIEF DESCRIPTION OF THE DRAWINGS

Additional objectives, features, advantages, and possible applications of the device can be gleaned from the following description of an exemplary embodiment on the basis of the drawings.

FIG. 3 is an additional—partly assembled—perspective view of the device.

FIG. 4 depicts the device with rotating metal/brake discs.

DETAILED DESCRIPTION

Figure 1:
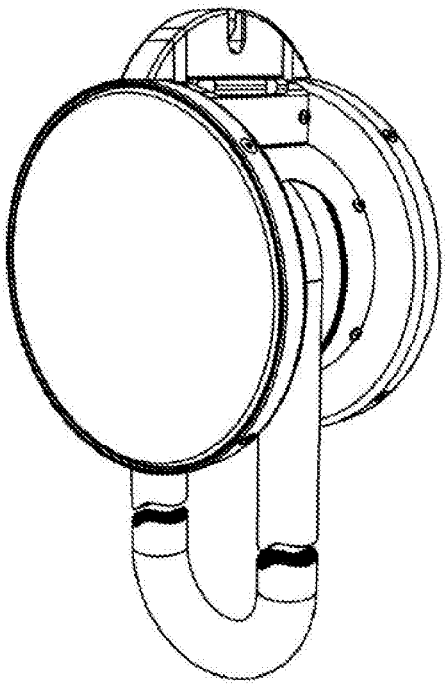
FIG. 1 is a perspective view of an exercise device in in its assembled state.

FIG. 1 shows an exemplary exercise device which is of very compact construction. The device comprises a guide member 2 around which a continuous pulling member (rope) 1 is wrapped. The continuous pulling member 1 can be pulled out of the device or guide member 2 against the resistance created by an eddy current brake. The pulling member 1 may be a rope, belt, band, chain, tube, or other similar flexible pulling member designed to be continuous, i.e. without a beginning and an end.

Figure 2A:
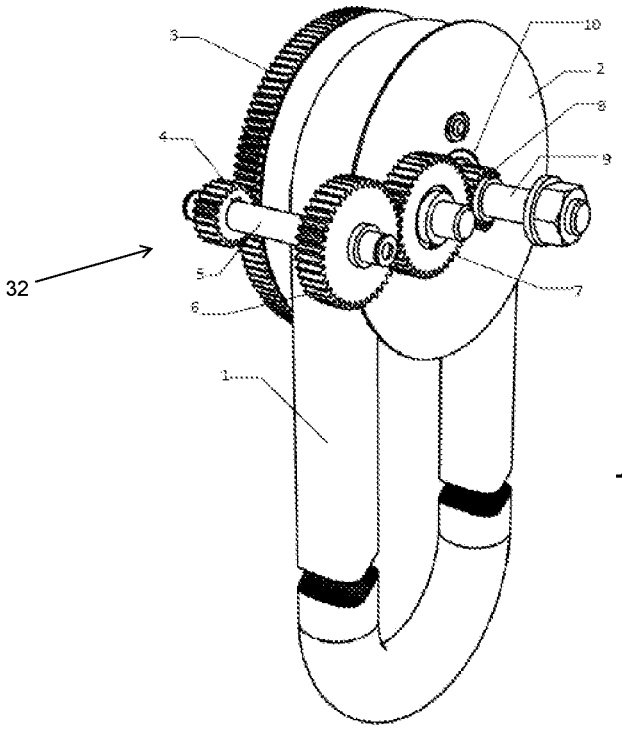
FIG. 2*a* and FIG. 2*b* provide a partially broken perspective view and a frontal view of the gear assembly of the device.
Figure 2B:
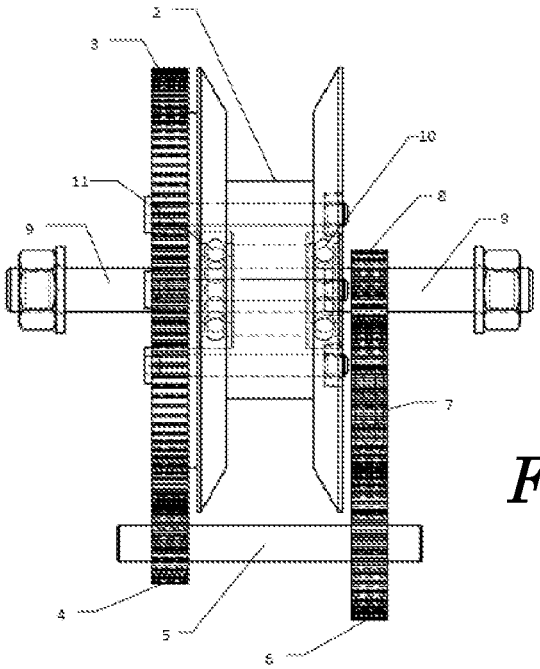

The device depicted schematically in FIG. 2*a* and FIG. 2*b* comprises a guide member 2 around which the pulling member 1 is wrapped. This guide member 2 is driven by the pulling member 1 when the exercise is performed. The rotation of the guide member 2 causes a rotation of a first gearwheel 3 that is arranged on the guide member 2, and which is preferably affixed to the guide member 2 with bolts. A second gearwheel 4 is driven by the first gearwheel 3. The second gearwheel 4 is fixed opposite a third gearwheel 6 on a gear shaft 5. The third gearwheel 6 drives a fourth gearwheel 7. The fourth gearwheel 7 drives a fifth gearwheel 8, which is fixed to a shaft 9. The shaft 9 is supported by bearings 10 and 11 supports the guide member 2. The gearwheels 3, 4, 6, 7, and 8 form a gear set 32. Based on their construction and configuration in the present exemplary embodiment, a ratio of 12:1 (one revolution of the guide member 2 causes 12 revolutions of the shaft 9) is provided with the guide member 2 and the shaft 9 counter-rotating.

As shown in FIG. 3, the device may comprise a mounting 12 (mounting bracket) to affix the device to suitable suspension points.

On either side of the guide member 2 are positioned a carrier plate 13 and a support plate 14. By means of a bearing 15 and an opposing bearing (not shown), the shaft 9 is supported in the carrier plate 13 and the support plate 14 while being able to turn freely.

A pressure roller (pressing means) 17 is provided on the front, which pushes the pulling member 1 into the guide member 2 in order to prevent slippage between the pulling member 1 and the guide member 2. The pressure roller 17 is mounted on the gear shaft 5 by bearing 18 and its opposing bearing (not shown) so as to be freely rotatable. The bearings 18 are positioned one on either side of the pressure roller 17. The pressure roller 17 can be driven in such a manner as to rotate at almost precisely the speed of the pulling member 1, and whereby slippage of the pulling member 1 is prevented by the addition of more traction area on the pulling member 1 and less pressure. The benefit of this is less wear on the pulling member 1.

Also visible in FIG. 3 are the regulator (adjustment wheel) 20 and the magnetic cylinder 21.

FIG. 4 depicts the two rotating metal/brake discs 22 and 23, which are affixed to the shaft 9 by the nut 24 and an opposing nut. The configuration of the gearwheels 3, 4, 6, 7, 8 described above allows the discs 22 and 23 to rotate with the shaft 9 in a ratio to the guide member of 12:1. When the device is in use, the inner surfaces of the outer edges of the metal/brake discs 22 and 23 rotate very closely past the magnetic cylinder 21. In this embodiment of the device, the largest braking effect is achieved by the axial penetration of the discs 22 and 23 by the magnetic field of the magnetic cylinder 21.

Figure 5A:
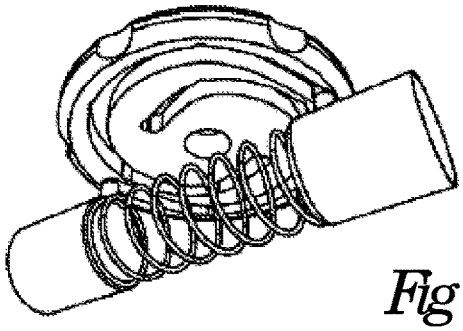
FIGS. 5*a*, 5*b*, 5*c*, and 5*d* show details of a magnetic cylinder and a regulator.
Figure 5B:
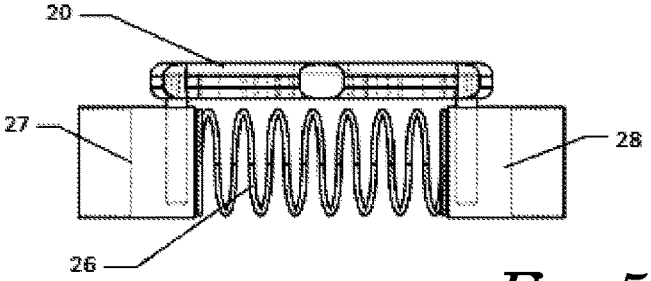
Figure 5C:
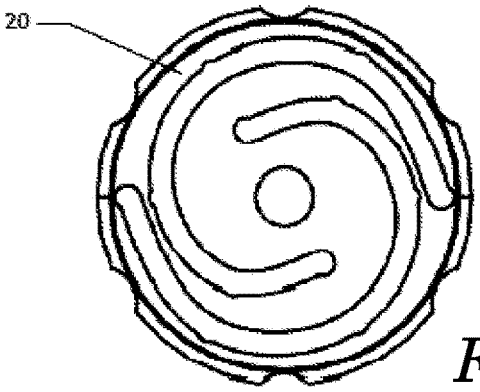
Figure 5D:
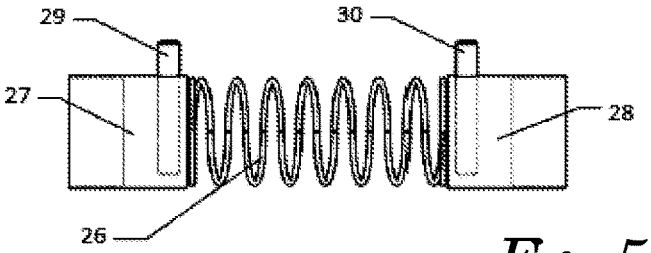

FIGS. 5*a-d* depict a specific embodiment of the magnetic cylinder 21 and the regulator 20. The magnetic cylinder 21 may comprise two spring-loaded cylindrical magnets 27, 28 (FIGS. 5*b*, 5*d*). The two magnets 27, 28 are forced apart by a spring 26. A pin 29, 30 (FIG. 5*d*) is provided on each magnet 27, 28. The pins 29, 30 project into guide slots on the regulator 20. By turning the regulator 20, the magnets 27, 28 are moved toward or away from one another.

Figure 6:
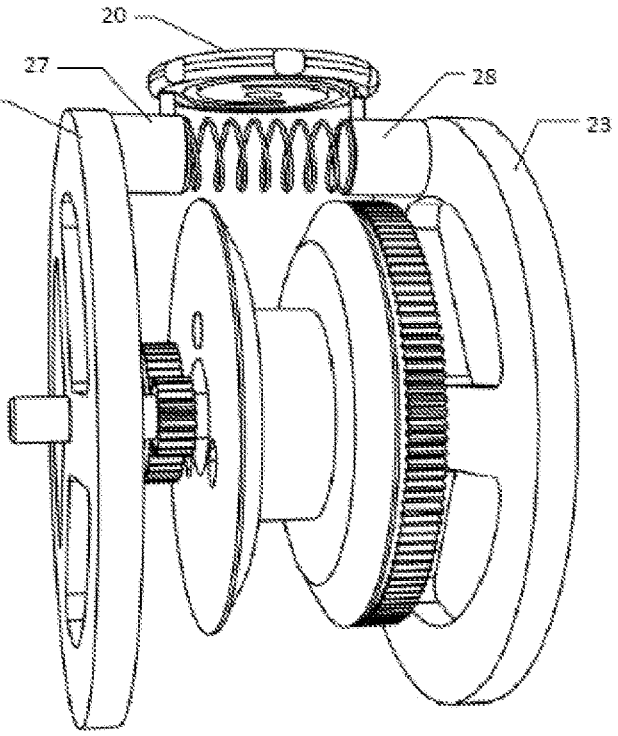
FIG. 6 is a schematic drawing of how two magnets are positioned along the metal/brake discs in the normal position of the regulator.

FIG. 6 depicts schematically how the two magnets 27, 28 are positioned next to the metal/brake discs 22, 23 in the normal position of the regulator 20. The eddy current brake is regulated by the regulator 20. The regulation is the result of the interaction between the magnets 27, 28 and the rotating metal/brake discs 22, 23.

Figure 7A:
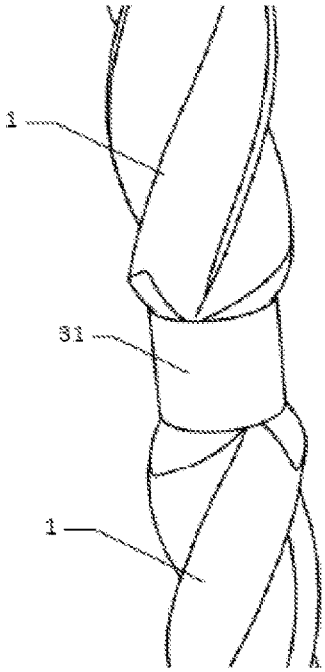
FIG. 7*a* and FIG. 7*b* depict both ends of a pulling member with a cylindrical connector ring.
Figure 7B:
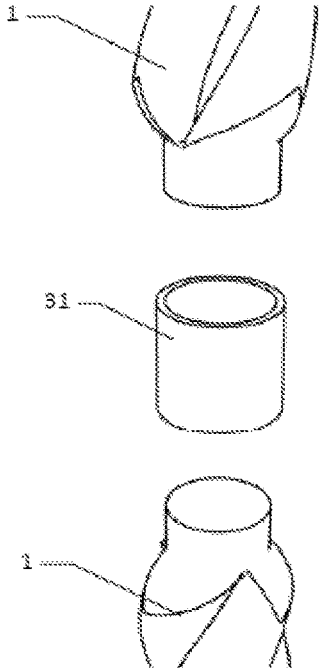

FIGS. 7*a*, 7*b* depict the two ends of the pulling member 1, which are formed (by means of pressure, heat, and friction) such that they are fitted into a cylinder-shaped connector ring 31 form-fittingly and force-fittingly. The connector ring 31 is made of a strong and sturdy material, and preferably has a smaller diameter than that of the pulling member 1. The connection itself is made using an adhesive.

The invention claimed is:

1. An exercise device, comprising:

a guide member rotatably arrange on a shaft;

a continuous, flexible pulling member which wraps around the guide member and causes the guide member to rotate when the continuous, flexible pulling member is pulled;

two rotatable metal discs arranged coaxially with the guide member on the shaft, one rotatable metal disc of the two rotatable metal discs being arranged on each side of the guide member;

a gear set operatively connecting the guide member and the two rotatable metal discs; and a magnetic cylinder arranged substantially parallel to the shaft between the two rotatable metal discs such that a magnetic field passes through radially outer areas of the rotatable metal discs in a substantially axial orientation, wherein the rotatable metal discs and the magnetic cylinder form an eddy current brake which counteracts a pulling motion on the continuous, flexible pulling member, and wherein the magnetic cylinder comprises two magnets which are adapted to be moved axially relative to each other by a regulator, thereby causing the eddy current brake to become more or less effective based on an axial position of the magnets within the magnetic cylinder.

2. The exercise device as in claim 1, further comprising a carrier plate and a support plate, the carrier plate and the support plate being arranged on opposite sides of the guide member.

3. The exercise device as in claim 2, wherein the carrier plate and the support plate are arranged between the guide member and the rotatable metal discs and wherein the shaft reaches through the carrier plate and the support plate.

4. The exercise device as in claim 3, wherein the shaft is fixedly connected to the rotatable metal discs and rotatably connected to the carrier plate, the support plate, and the guide member by bearings.

5. The exercise device as in claim 1, wherein the gear set comprises a plurality of gears with a predetermined transmission ratio between the guide member and the two rotatable metal discs.

6. The exercise device as in claim 5, wherein the predetermined transmission ratio between the guide member and the two rotatable metal discs is 1:12.

7. The exercise device as in claim 1, wherein the two magnets are cylinder-shaped and comprise pins which engage a guide channel in the regulator, and wherein relative movement of the magnets is affected by rotating the regulator.

8. The exercise device as in claim 1, further comprising a mounting for attaching the device.

9. The exercise device as in claim 1, further comprising a pressure roller arranged to push the continuous, flexible pulling member into the guide member.

10. An exercise device, comprising:

a guide member rotatably arrange on a shaft;

a continuous, flexible pulling member which wraps around the guide member and causes the guide member to rotate when the continuous, flexible pulling member is pulled;

two rotatable metal discs arranged coaxially with the guide member on the shaft, one rotatable metal disc of the two rotatable metal discs being arranged on each side of the guide member;

a gear set operatively connecting the guide member and the two rotatable metal discs; and a magnetic cylinder arranged substantially parallel to the shaft between the two rotatable metal discs such that a magnetic field passes through radially outer areas of the rotatable metal discs in a substantially axial orientation, wherein the rotatable metal discs and the magnetic cylinder form an eddy current brake which counteracts a pulling motion on the continuous, flexible pulling member, and wherein the gear set comprises a plurality of gears, the plurality of gears providing a predetermined transmission ratio between the guide member and the two rotatable metal discs.

11. The exercise device as in claim 10, further comprising a carrier plate and a support plate, the carrier plate and the support plate being arranged on opposite sides of the guide member.

12. The exercise device as in claim 11, wherein the carrier plate and the support plate are arranged between the guide member and the rotatable metal discs and wherein the shaft reaches through the carrier plate and the support plate.

13. The exercise device as in claim 12, wherein the shaft is fixedly connected to the rotatable metal discs and rotatably connected to the carrier plate, the support plate, and the guide member by bearings.

14. The exercise device as in claim 10, wherein the predetermined transmission ratio between the guide member and the two rotatable metal discs is 1:12.

15. The exercise device as in claim 10, further comprising a pressure roller arranged to push the continuous, flexible pulling member into the guide member.

16. An exercise device, comprising:

a guide member rotatably arrange on a shaft;

a continuous, flexible pulling member which wraps around the guide member and causes the guide member to rotate when the continuous, flexible pulling member is pulled;

two rotatable metal discs arranged coaxially with the guide member on the shaft, one rotatable metal disc of the two rotatable metal discs being arranged on each side of the guide member;

a gear set operatively connecting the guide member and the two rotatable metal discs;

a magnetic cylinder arranged substantially parallel to the shaft between the two rotatable metal discs such that a magnetic field passes through radially outer areas of the rotatable metal discs in a substantially axial orientation; and a carrier plate and a support plate, the carrier plate and the support plate being arranged on opposite sides of the guide member, wherein the rotatable metal discs and the magnetic cylinder form an eddy current brake which counteracts a pulling motion on the continuous, flexible pulling member, and wherein the carrier plate and the support plate are arranged between the guide member and the rotatable metal discs and wherein the shaft reaches through the carrier plate and the support plate.

17. The exercise device as in claim 16, wherein the shaft is fixedly connected to the rotatable metal discs and rotatably connected to the carrier plate, the support plate, and the guide member by bearings.

18. The exercise device as in claim 16, further comprising a pressure roller arranged to push the continuous, flexible pulling member into the guide member.

* * * * *